US010808468B2

(12) United States Patent
Vo

(10) Patent No.: US 10,808,468 B2
(45) Date of Patent: Oct. 20, 2020

(54) SPINNER TOOL WITH FLOATING CARRIAGE DEVICE

(71) Applicant: FORUM US, INC, Houston, TX (US)

(72) Inventor: Han Vo, Cypress, TX (US)

(73) Assignee: FORUM US, INC., Houston, TX (US)

( * ) Notice: Subject to any disclaimer, the term of this patent is extended or adjusted under 35 U.S.C. 154(b) by 309 days.

(21) Appl. No.: 15/609,266

(22) Filed: May 31, 2017

(65) Prior Publication Data

US 2018/0347294 A1 Dec. 6, 2018

(51) Int. Cl.
*E21B 19/16* (2006.01)

(52) U.S. Cl.
CPC ..... *E21B 19/161* (2013.01); *E21B 19/168* (2013.01)

(58) Field of Classification Search
CPC ..... E21B 19/161; E21B 19/168; B25B 17/00; B25B 13/481; B25B 13/467; B25B 17/02; B25B 21/002
USPC ..... 15/57.33, 57.35
See application file for complete search history.

(56) References Cited

U.S. PATENT DOCUMENTS 3,589,742 A * 6/1971 Flick ..... E21B 19/164 269/235
4,023,449 A 5/1977 Boyadjieff
4,401,000 A * 8/1983 Kinzbach ..... E21B 19/164 81/57.15
4,402,239 A * 9/1983 Mooney ..... E21B 19/166 81/57.16
4,515,045 A * 5/1985 Gnatchenko ..... E21B 19/164 81/409
4,648,292 A * 3/1987 Haynes ..... E21B 19/164 81/57.16
5,161,438 A * 11/1992 Pietras ..... E21B 19/164 81/57.16
6,116,118 A * 9/2000 Wesch, Jr. ..... E21B 19/161 81/57.16
6,318,214 B1 * 11/2001 Buck ..... E21B 19/164 81/57.16
7,000,502 B2 * 2/2006 Belik ..... E21B 19/161 81/57.2
7,036,396 B2 * 5/2006 Moe ..... E21B 19/168 81/57.2
7,313,986 B2 1/2008 West et al.
(Continued)

FOREIGN PATENT DOCUMENTS

WO 2016074060 A1 5/2016

OTHER PUBLICATIONS

International Search Report and Written Opinion dated Aug. 14, 2018, Corresponding to Application No. PCT/US2018/031807.

*Primary Examiner* — Bryan R Muller
(74) *Attorney, Agent, or Firm* — Patterson & Sheridan, L.L.P.

(57) ABSTRACT

A spinner tool includes a plurality of rollers configured to rotate a tubular and a linkage assembly configured to move the rollers into and out of contact with the tubular. The tool further includes a carriage assembly configured to support the linkage assembly. The carriage assembly has a frame, a pair of carriage rollers positioned on opposite sides of the frame, and a pair of spring cylinders positioned on opposite sides of each carriage roller. The spring cylinders are coupled at one end to the carriage roller and at an opposite end to the frame to force the carriage assembly into a centered position.

20 Claims, 11 Drawing Sheets

(56) References Cited

U.S. PATENT DOCUMENTS

| | | | | |
|---|---|---|---|---|
| 7,455,128 | B2 * | 11/2008 | Belik | E21B 19/00 175/162 |
| 7,690,281 | B2 * | 4/2010 | Hobgood | E21B 19/165 81/57.35 |
| 7,958,787 | B2 * | 6/2011 | Hunter | E21B 19/165 73/862.21 |
| 8,601,910 | B2 | 12/2013 | Begnaud | |
| 2009/0211404 | A1 | 8/2009 | Pedersen et al. | |
| 2009/0272235 | A1 | 11/2009 | Berry | |
| 2016/0290075 | A1 | 10/2016 | Hunter | |

* cited by examiner

SPINNER TOOL WITH FLOATING CARRIAGE DEVICE

BACKGROUND

Field

Embodiments disclosed herein relate to a spinner tool for coupling or de-coupling tubulars in a drilling or workover operation utilized in the oil and gas industry.

Description of the Related Art

A spinner (also known as a "pipe spinner") is commonly used in the oil and gas industry to rotate a tubular when making up or breaking out a threaded connection. The spinner rotates an upper tubular relative to a lower tubular to thread the tubulars together during a make-up operation, and rotates the upper tubular in an opposite direction to unthread the tubulars from each other during a break-out operation. The spinner is a relatively low torque, high speed device used for the initial makeup or final break-out of a threaded connection. A torque wrench is a relatively high torque, low speed device that is subsequently used to provide a greater amount of torque to complete or initially break-out the threaded connection.

The spinner is usually suspended above both the torque wrench and a rotary spider that is located in a rig floor. The spinner has a pair of arms with rollers that are moved into contact with the upper tubular and are configured to rotate the upper tubular relative to the lower tubular held by the torque wrench and/or the rotary spider to couple the two tubulars together.

One problem that often occurs is that the spinner grips the upper tubular in a position such that the center axis of the upper tubular is offset from the center axis of the spinner. This is caused when one of the rollers of the spinner contacts the upper tubular prior to the others, which results in a misalignment of the spinner with the center axis of the tubular. Since the upper tubular is offset, the upper tubular will begin to "whip" about the center axis of the spinner as it is rotated by the spinner. This whipping motion often leads to an incomplete shouldering of the threaded connection between the upper tubular and the lower tubular, which requires additional rotation of the upper tubular, thereby increasing the amount of time it takes to making up each threaded connection.

Therefore, there exists a need for new and/or improved spinners.

SUMMARY

In one embodiment, a spinner tool comprises a plurality of rollers configured to rotate a tubular, a linkage assembly configured to move the rollers into and out of contact with the tubular, and a carriage assembly configured to support the linkage assembly, wherein the carriage assembly has a frame, a pair of carriage rollers positioned on opposite sides of the frame, and a pair of spring cylinders positioned on opposite sides of each carriage roller, wherein the spring cylinders are coupled at one end to the carriage roller and at an opposite end to the frame to force the carriage assembly into a centered position.

BRIEF DESCRIPTION OF THE DRAWINGS

To facilitate understanding, identical reference numerals have been used, where possible, to designate identical elements that are common to the figures. It is contemplated that elements disclosed in one embodiment may be beneficially utilized with other embodiments without specific recitation.

DETAILED DESCRIPTION

Embodiments of the disclosure relate to a floating carriage assembly of a spinner tool for making up and breaking out a threaded connection between two tubulars. The spinner tool is a relatively low torque, high speed device used for the initial makeup of the threaded connection. The carriage assembly is configured to allow the spinner tool to move laterally and vertically during operation, which allows the spinner tool to align with the center axis of a tubular during a make-up or break-out operation.

Figure 1:
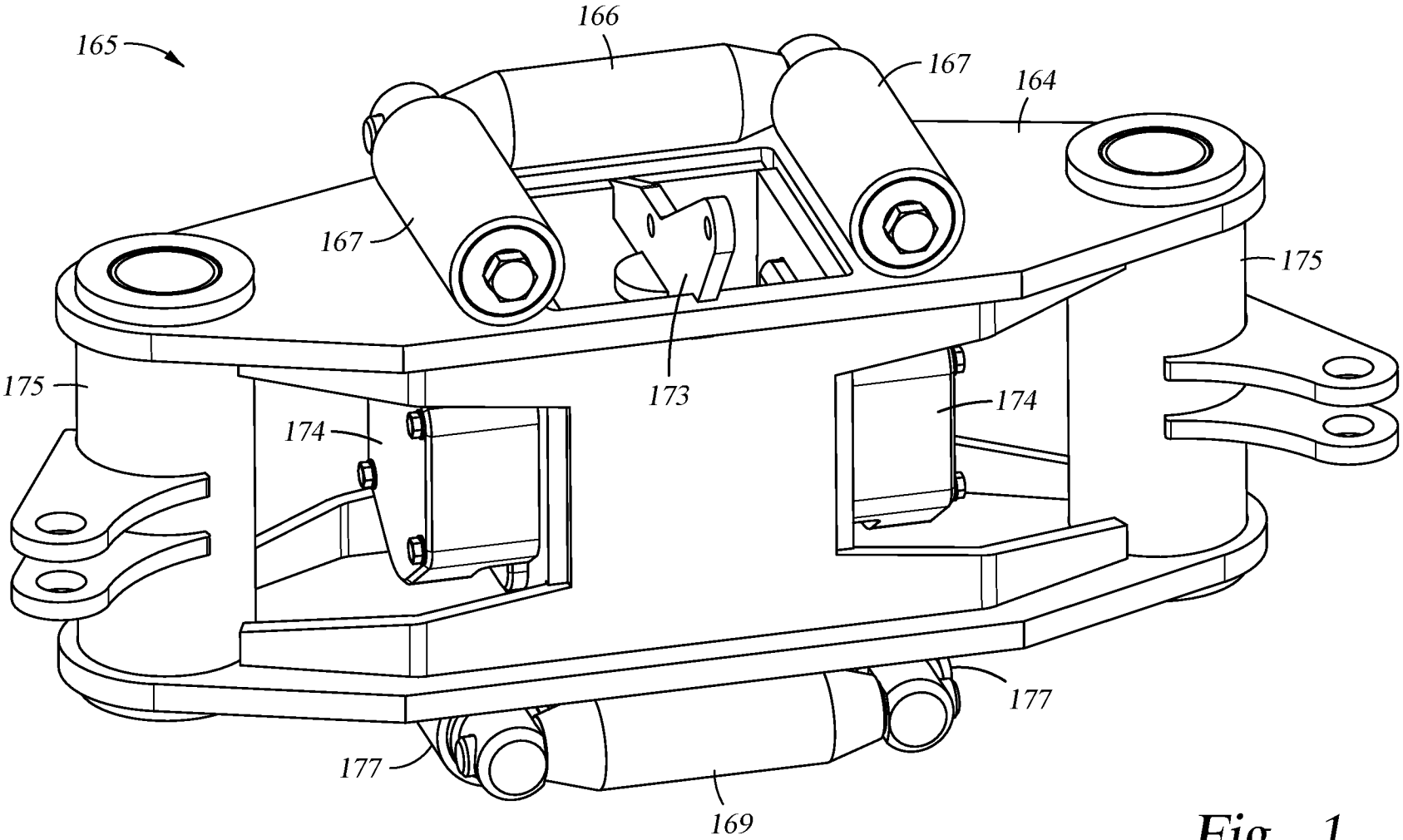
FIG. 1 is a front isometric view of a carriage assembly for a spinner tool according to one embodiment.
Figure 2:
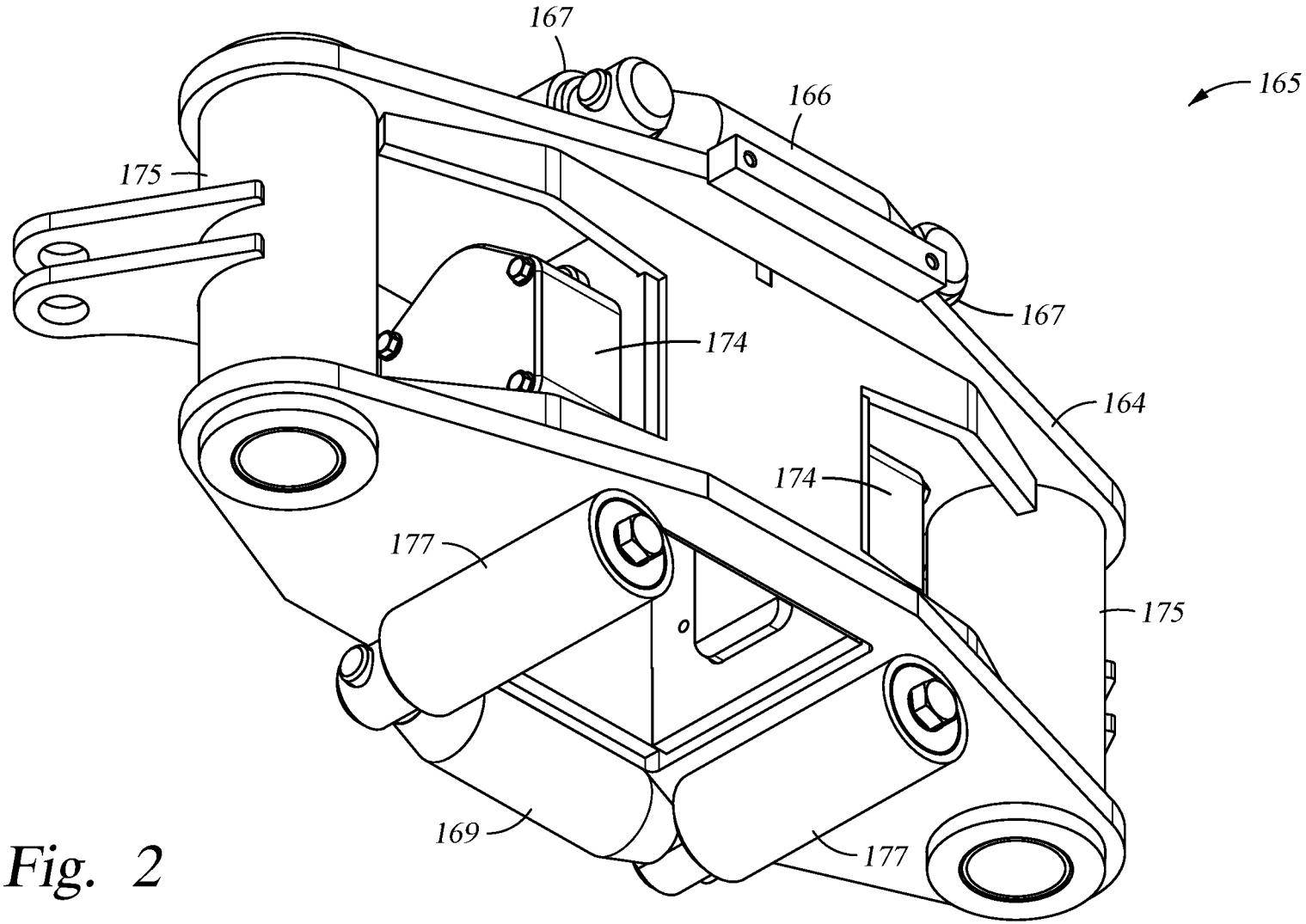
FIG. 2 is a rear isometric view of the carriage assembly.
Figure 3:
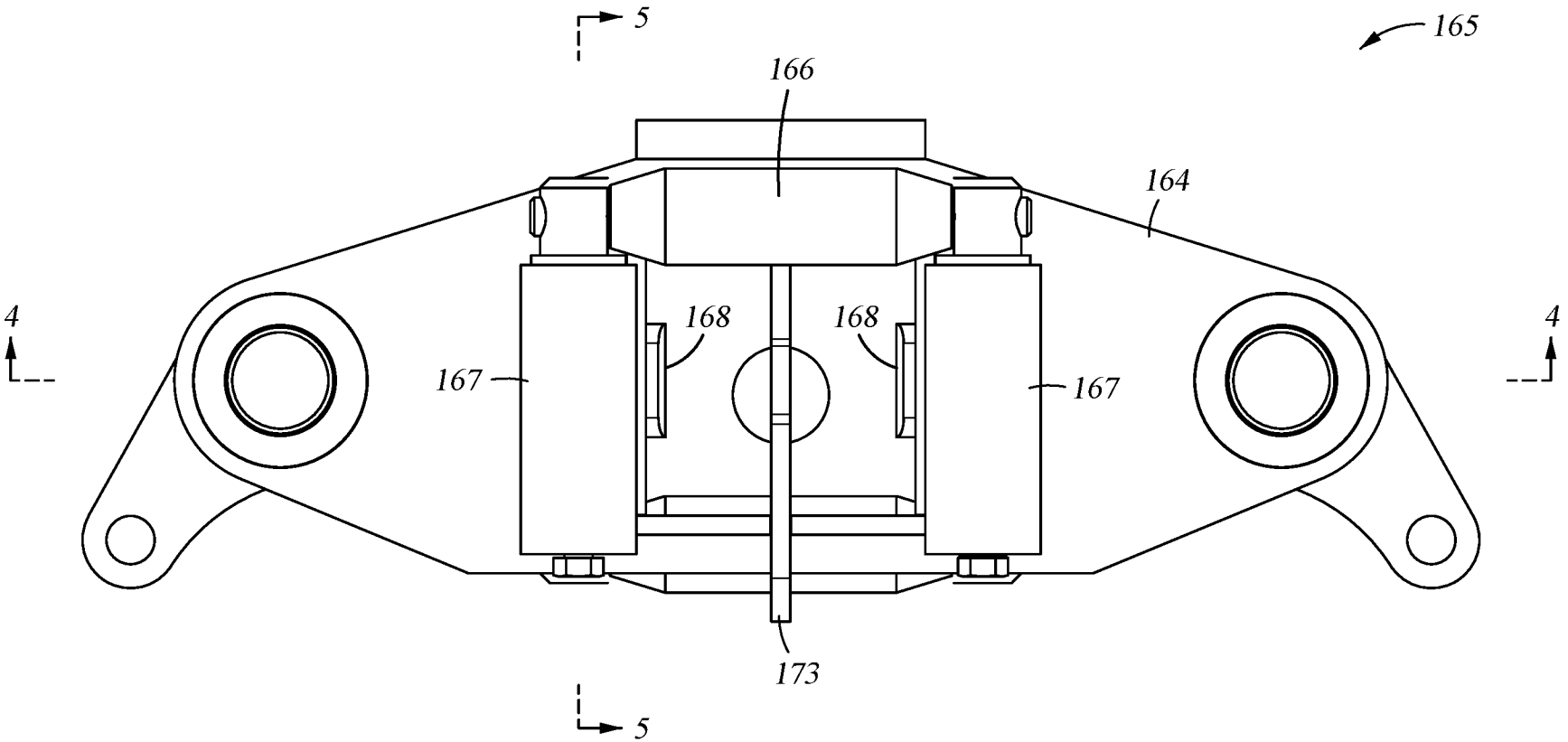
FIG. 3 is a top plan view of the carriage assembly.
Figure 4:
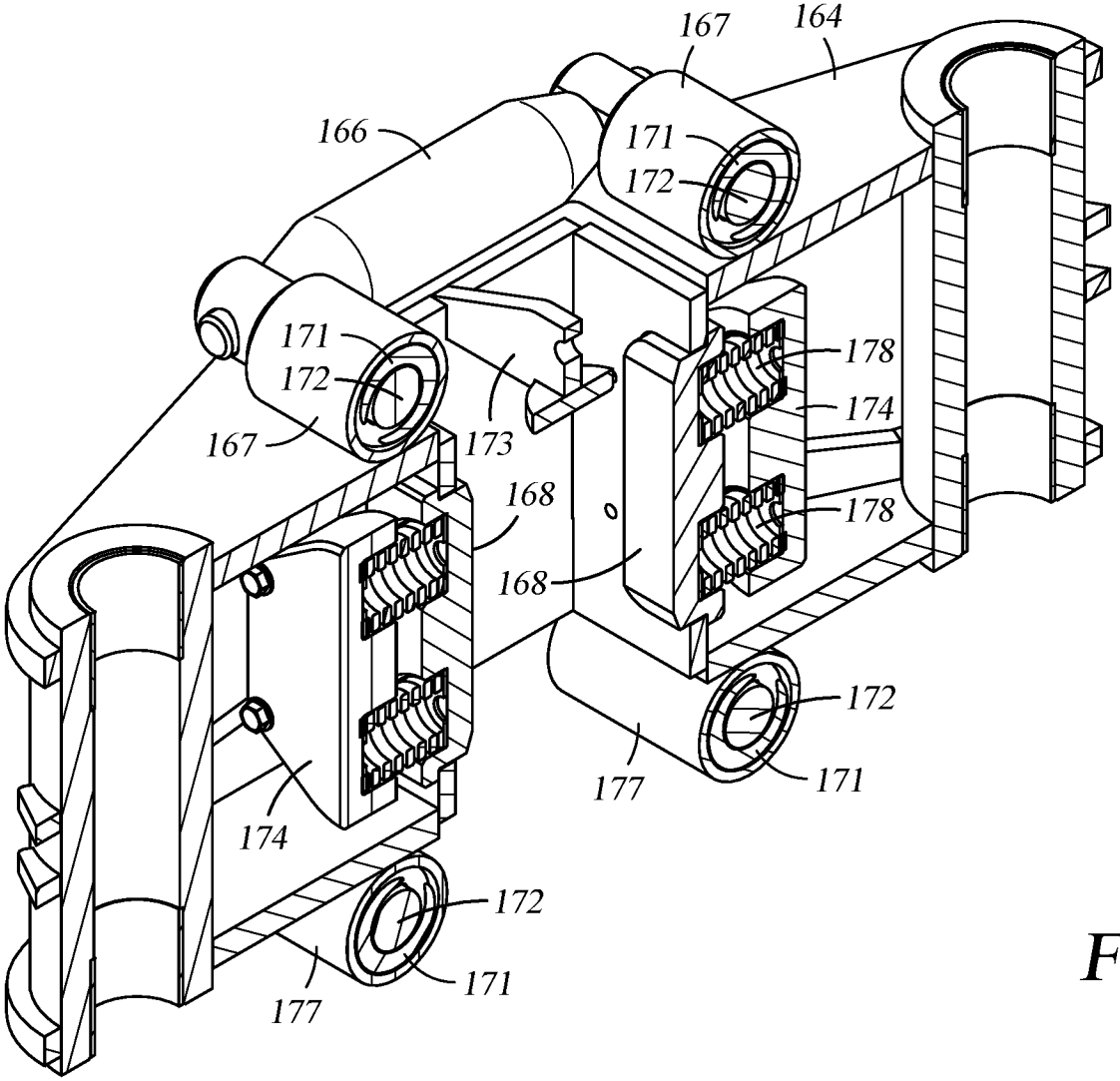
FIG. 4 is a sectional view of the carriage assembly taken along line 4-4 of FIG. 3.
Figure 5:
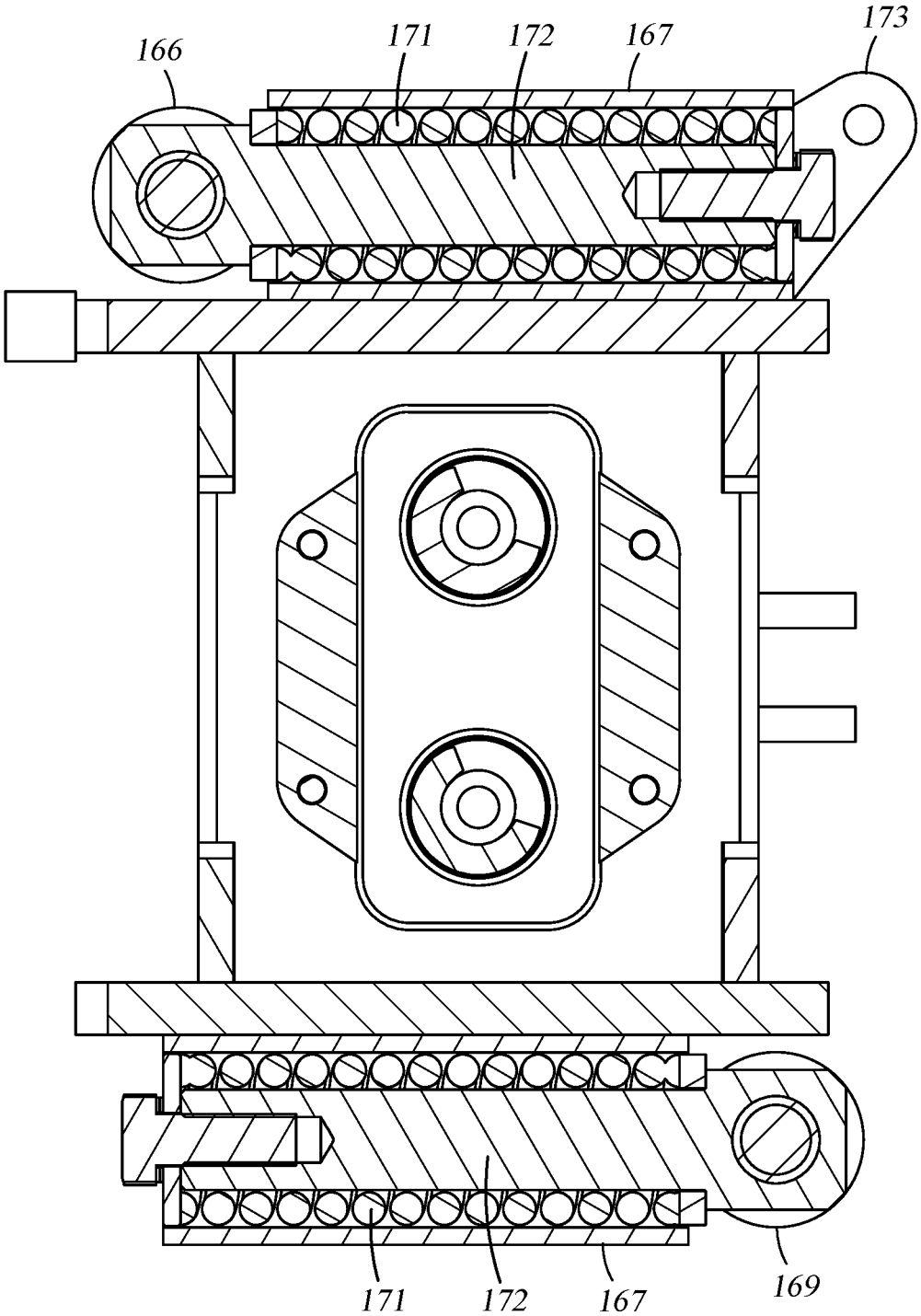
FIG. 5 is a sectional view of the carriage assembly taken along line 5-5 of FIG. 3.

FIG. 1 is a front isometric view of a carriage assembly 165 for a spinner tool 100 (shown in FIGS. 6-11) according to one embodiment. FIG. 2 is a rear isometric view of the carriage assembly 165. FIG. 3 is a top plan view of the carriage assembly 165. FIG. 4 is a sectional view of the carriage assembly 165 taken along line 4-4 of FIG. 3. FIG. 5 is a sectional view of the carriage assembly 165 taken along line 5-5 of FIG. 3.

The carriage assembly 165 includes a frame 164 and a pair of carriage rollers 166, 169 positioned on opposite sides (e.g. top and bottom) of the frame 164. The roller 166 is positioned on top near the rear side of the frame 164, while the roller 169 is positioned on bottom near the front side of the frame 164. Each roller 166, 169 includes a pair of spring cylinders 167, 177 coupled to the ends of each roller 166, 169, respectively. The spring cylinders 167, 177 are coupled at one end to one roller 166, 169 and at an opposite end to the frame 164.

Springs 171 disposed within the spring cylinders 167, 177 apply a force to rod members 172, which are coupled at one end to rollers 166, 169, to force the carriage assembly 165 into a centered position. The rollers 166, 167 and spring cylinders 167, 177 help keep the carriage assembly 165 level during operation when the spinner tool 100 is not gripping a tubular. Wear pad housings 174 are coupled to the frame 164 and enclose springs 178 that are configured to bias wear pads 168 toward the interior of the frame 167. The wear pads 168 help minimize friction and wear of the carriage assembly 165 during operation.

Figure 10:
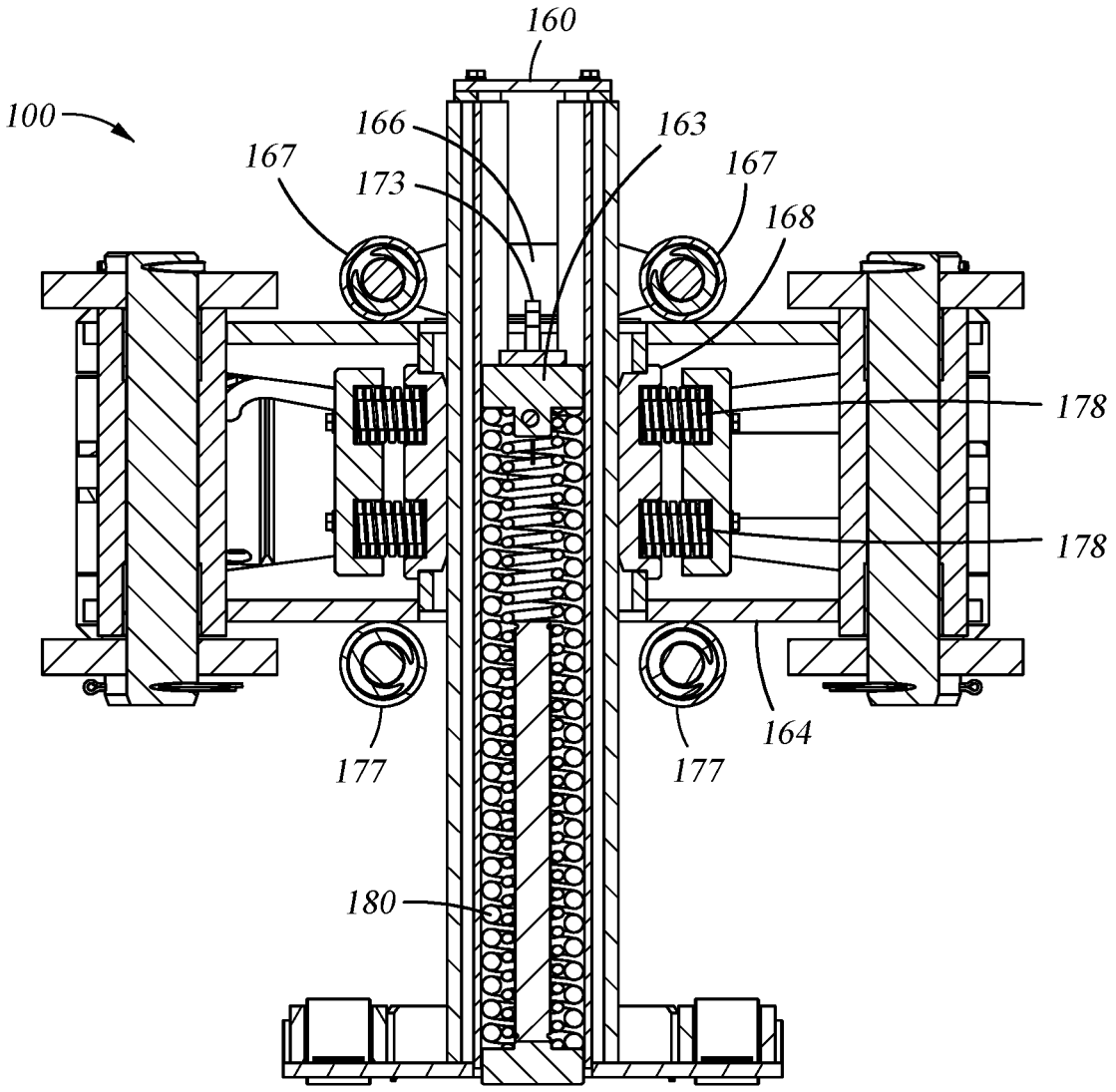
FIG. 10 is a sectional view of the spinner tool taken along line 10-10 of FIG. 9.
Figure 11:
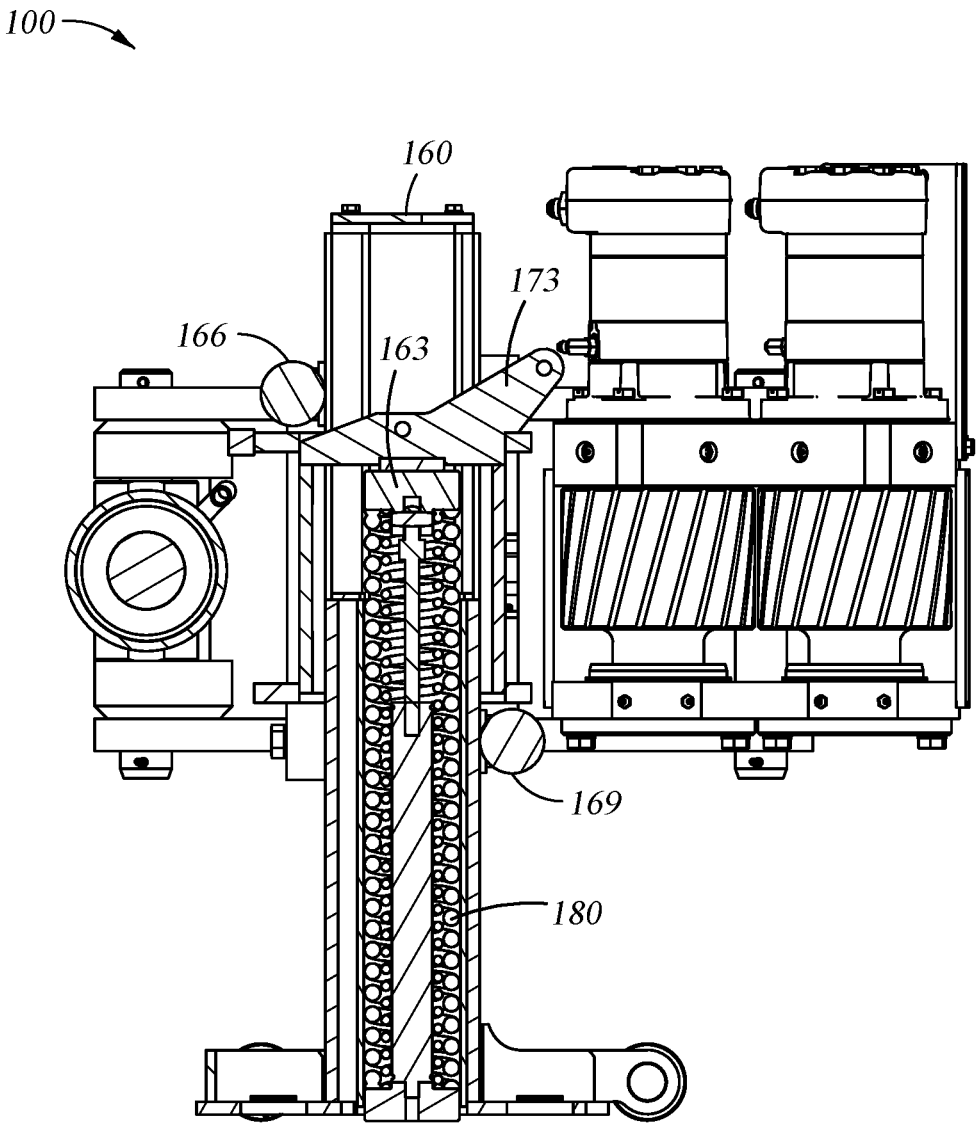
FIG. 11 is a sectional view of the spinner tool taken along line 11-11 of FIG. 9.

A support member 173 is coupled to the frame 164 and supports the frame 164 on top of a spring 180 located in a column structure 160 (as shown in FIGS. 10 and 11) of the spinner tool 100. The support member 173 is coupled to (or sits on top of) a block member 163 that is positioned on the spring 180. The carriage assembly 165 is coupled to and floats on the spring 180 to allow the spinner tool 100 to move up and down along the column structure 160 when making up or breaking out a threaded connection between two tubulars. In addition, the rollers 166, 169 are positioned on opposite sides of the column structure 160 to keep the spinner tool 100 level and prevent sagging or tilting.

When gripping a tubular that is offset from the center axis of the spinner tool 100, the carriage assembly 165 may be forced laterally (e.g. where the frame 164 is slightly turned or rotated) relative to the column structure 160, thereby compressing one or more of the springs 171 in one or both of the spring cylinders 167, 177. The rollers 166, 169 and the spring cylinders 167, 177 allow the spinner tool 100 to move laterally relative to the column structure 160 to adjust for any misalignment between the tubular and the spinner tool 100 when making up or breaking out a threaded connection.

Since the carriage assembly 165 is configured to adjust for any misalignment with the tubular, the rotation provided by the spinner tool 100 is applied about the center axis of the tubular, which prevents any "whipping" of the upper end of the tubular. The carriage assembly 165 of the spinner tool 100 is configured to adjust for the misalignment with the tubular that it is rotating to ensure complete shouldering of the threaded connection between tubulars during make-up.

When making up a threaded connection, the spinner tool 100 may be forced down along the column structure 160 when gripping a tubular as the pin end of the tubular is threaded down into the box end of another tubular, thereby compressing the spring 180 disposed within the column structure 160. When the spinner tool 100 releases the tubular, the spring 180 forces the spinner tool 100 back up along the column structure 160 to a centered and level position. Also, when the spinner tool 100 releases the tubular, the springs 171 in the spring cylinders 167, 177 forces the carriage assembly 165 back to a centered and level position.

Figure 6:
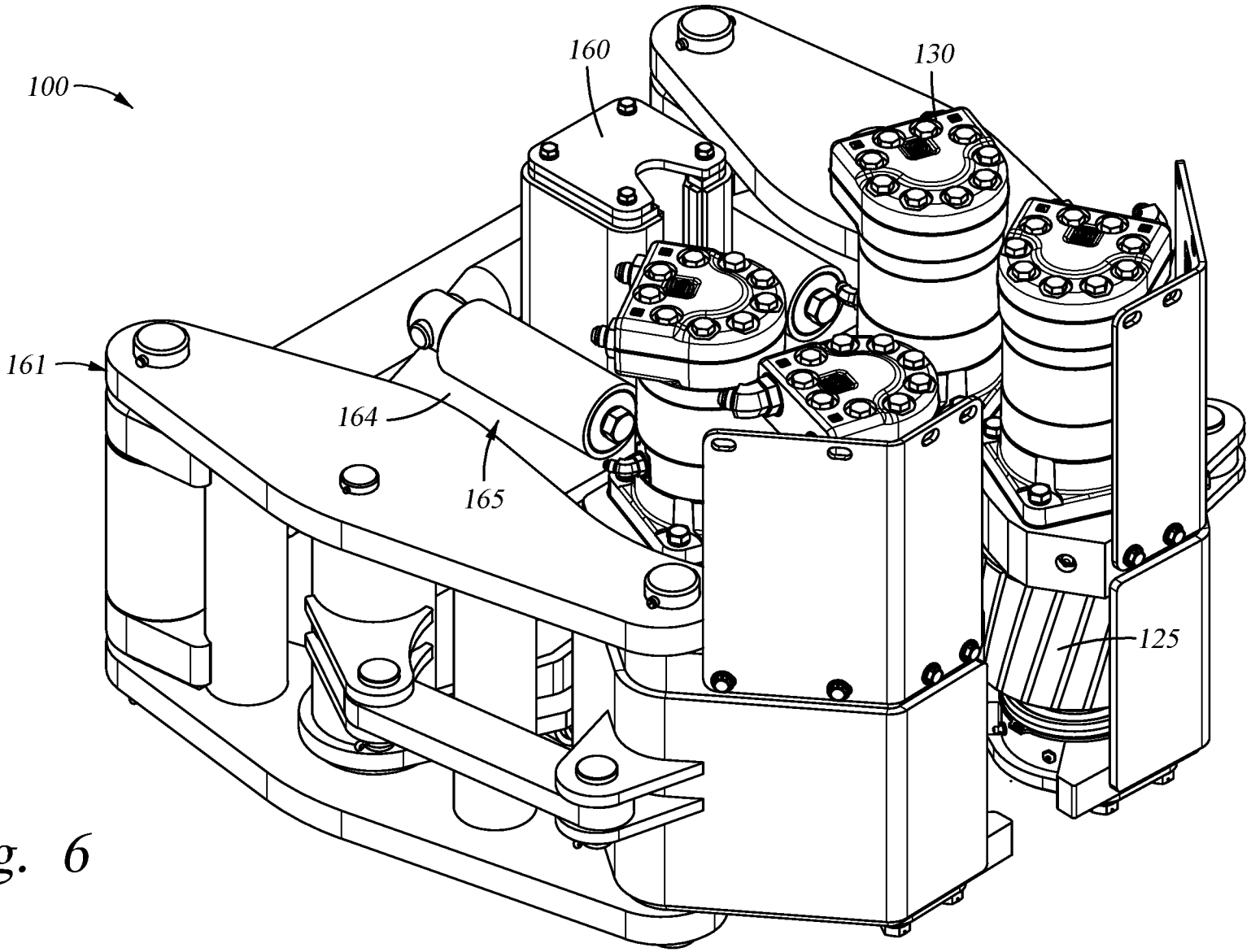
FIG. 6 is an isometric view of the spinner tool according to one embodiment.
Figure 7:
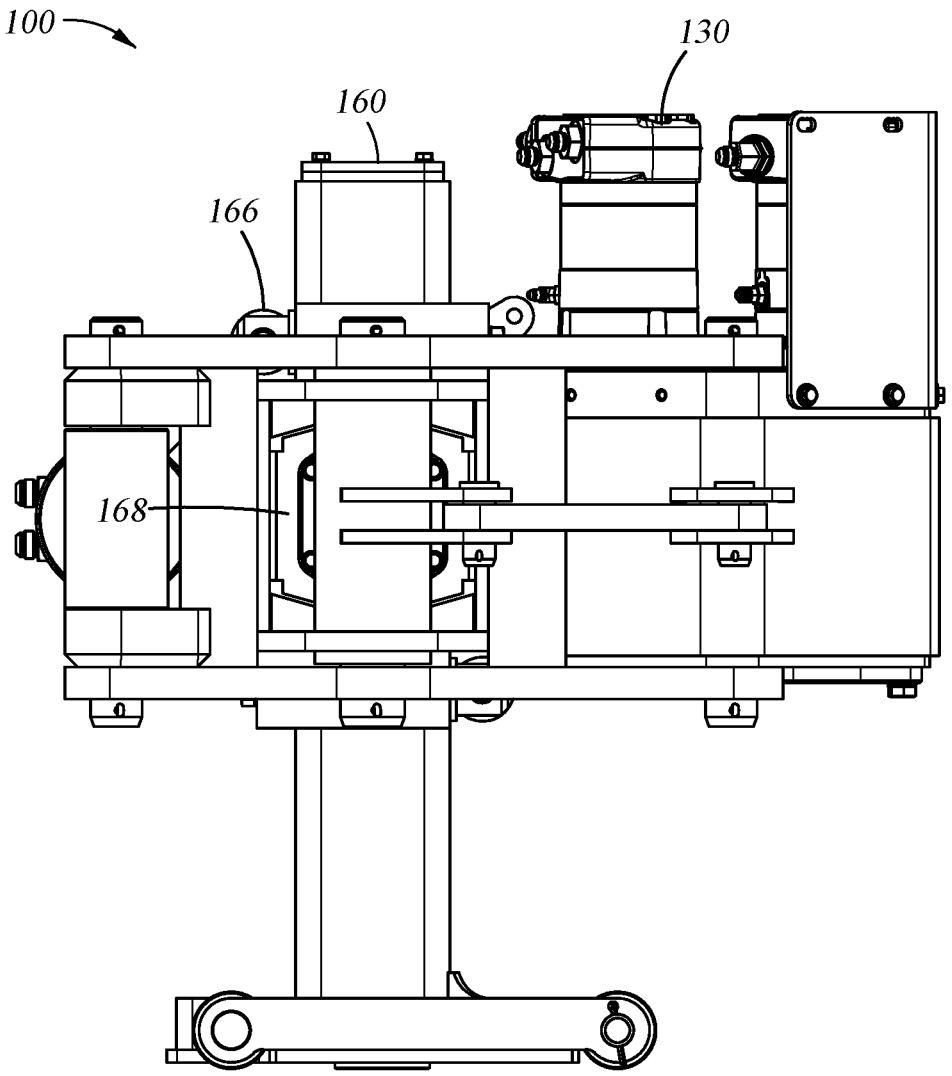
FIG. 7 is a side view of the spinner tool.
Figure 8:
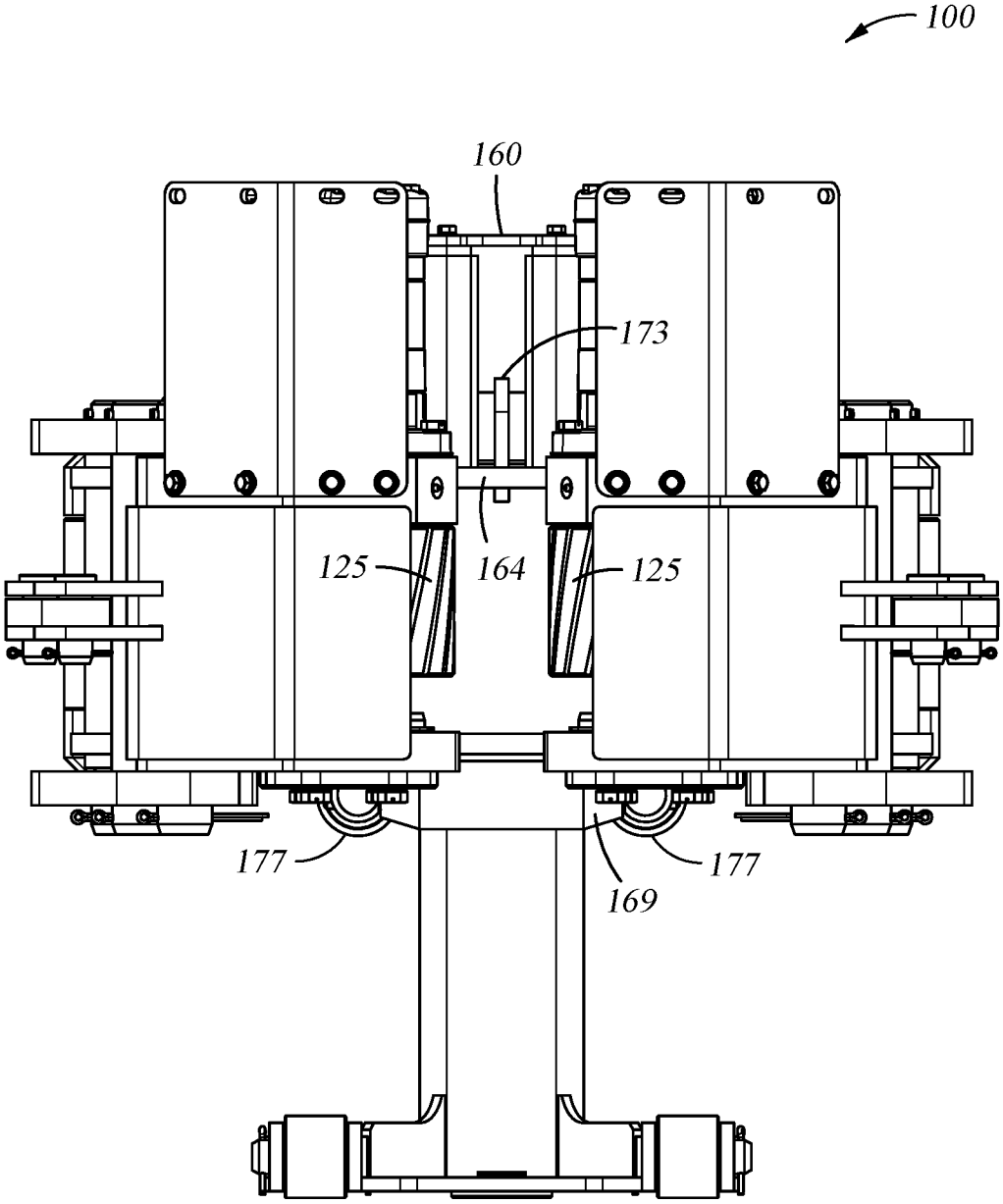
FIG. 8 is a front view of the spinner tool.
Figure 9:
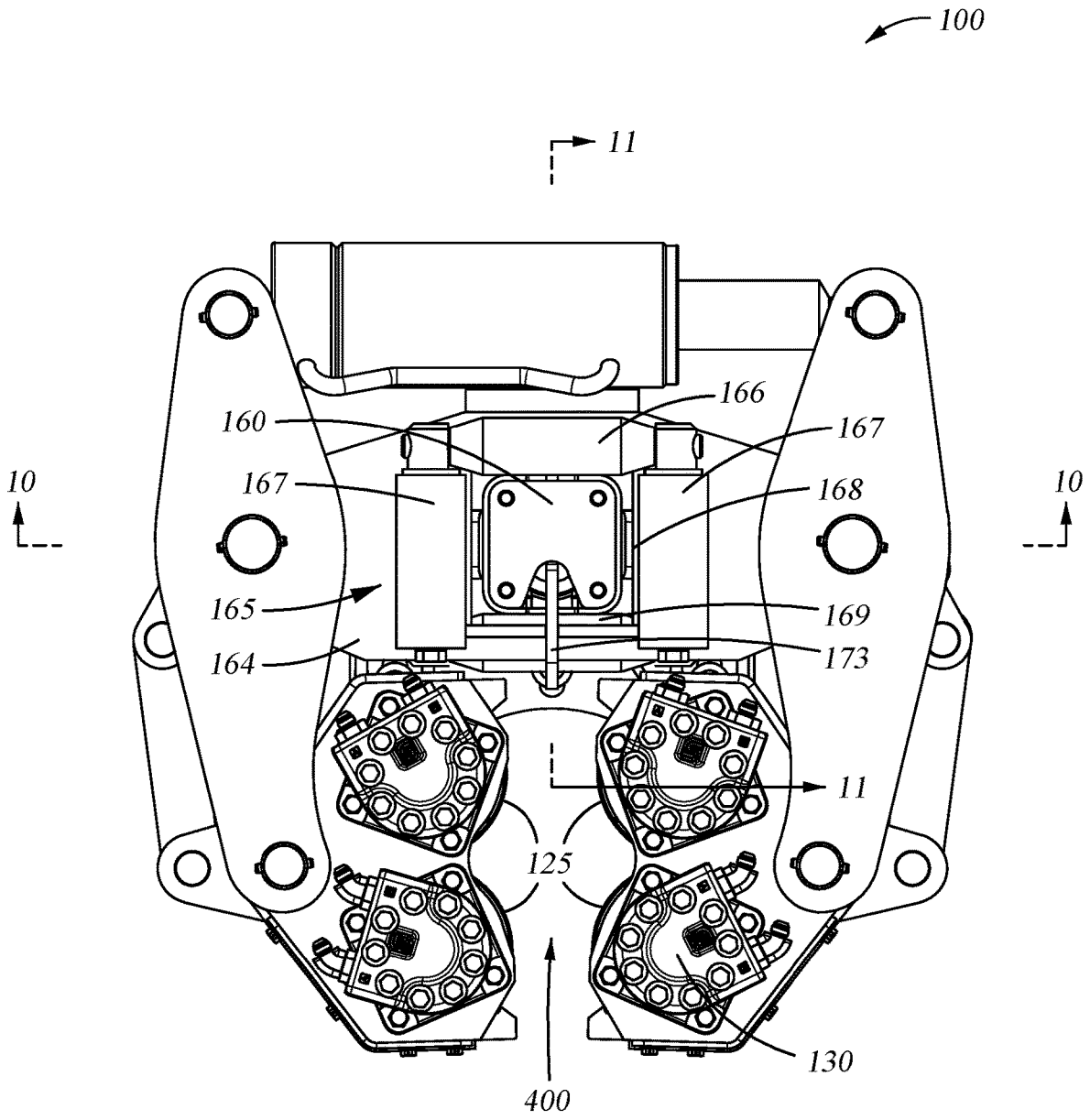
FIG. 9 is a top plan view of the spinner tool.

FIGS. 6-11 are various views of one embodiment of the spinner tool 100. FIG. 6 is an isometric view of the spinner tool 100. FIG. 7 is a side view of the spinner tool 100. FIG. 8 is a front view of the spinner tool 100. FIG. 9 is a top view of the spinner tool 100. FIG. 10 is a sectional view of the spinner tool 100 taken along line 10-10 of FIG. 9. FIG. 11 is a sectional view of the spinner tool 100 taken along line 11-11 of FIG. 9.

The spinner tool 100 includes a linkage assembly 161 that is pivotably coupled to support members 175 of the frame 164 of the carriage assembly 165. Four rollers 125 are coupled to the linkage assembly 161, which is configured to move the rollers 125 into an out of contact with a tubular. The rollers 125 are each rotatably driven by a motor 130 to rotate the tubular. The spinner tool 100 floats on the spring 180 located within the column structure 160 via the carriage assembly 165.

In a make-up operation, the spinner tool 100 is brought into proximity with a lower tubular that is held in place by a wrench or a rotary spider on a rig floor for example. A pin end of an upper tubular is positioned on top of a box end of the lower tubular by an elevator or top drive for example. The upper tubular is positioned within an opening 400 (shown in FIG. 9) in proximity with the rollers 125 of the spinner tool 100. The rollers 125 are actuated into contact with the upper tubular and are rotated by the motors 130 at a relatively low torque and high speed to rotate the upper tubular relative to the lower tubular. Once the threads are tightened, the rollers 125 are actuated out of contact with the upper tubular.

As stated above, the carriage assembly 165 allows the spinner tool 100 to move laterally to align with the center axis of the upper tubular so that the torque applied to the tubular is applied about the center axis of the upper tubular, which prevents any whipping motion of the upper tubular when rotated. The rollers 166, 169 help keep the spinner tool 100 level during operation and prevent sagging or tilting of the rollers 125 that rotate the upper tubular. The rollers 166, 169 roll along the column structure 160 and the wear pads 168 slide along the column structure 160 as the spinner tool 100 is moved vertically. After the spinner tool 100 releases the upper tubular, the springs 171 in the spring cylinders 167, 177 help force the spinner tool 100 back to a centered position on the column structure 160.

While the foregoing is directed to embodiments of the disclosure, other and further embodiments of the disclosure thus may be devised without departing from the basic scope thereof, and the scope thereof is determined by the claims that follow.

The invention claimed is:

1. A spinner tool, comprising;

a plurality of rollers configured to rotate a tubular;

a linkage assembly configured to move the rollers into and out of contact with the tubular; and a carriage assembly configured to support the linkage assembly, wherein the carriage assembly has a frame, a pair of carriage rollers positioned on opposite sides of the frame and configured to roll along a column structure supporting the carriage assembly as the carriage assembly moves vertically along the column structure, and a pair of spring cylinders positioned on opposite sides of each one of the pair of carriage rollers and adjacent to the respective one of the pair of carriage rollers, wherein the spring cylinders are coupled at one end to the respective one of the pair of carriage rollers and at an opposite end to the frame to force the carriage assembly into a centered position.

2. The spinner tool of claim 1, further comprising a spring disposed in each spring cylinder configured to force the carriage rollers into a centered position.

3. The spinner tool of claim 1, further comprising a pair of wear pad housings coupled to the frame, and wear pads that are biased toward an interior of the frame by springs located within the wear pad housings.

4. The spinner tool of claim 1, wherein the carriage assembly is coupled to the column structure such that the carriage rollers are positioned on opposite sides of the column structure to keep the plurality of rollers level.

5. The spinner tool of claim 4, wherein the carriage assembly is supported on a spring located within the column structure.

6. The spinner tool of claim 5, wherein the carriage assembly is moveable up and down along the column structure.

7. The spinner tool of claim 1, wherein one of the pair of carriage rollers is positioned on top of the frame, and wherein the other of the pair of carriage rollers is positioned on bottom of the frame.

8. The spinner tool of claim 1, wherein one of the pair of carriage rollers is positioned near a rear side of the frame, and wherein the other of the pair of carriage rollers is positioned near a front side of the frame.

9. The spinner tool of claim 1, further comprising a rod member disposed in each spring cylinder, wherein each rod member is coupled at one end to one of the pair of carriage rollers and is biased at an opposite end by a spring located in the spring cylinder to force the carriage assembly into the centered position.

10. The spinner tool of claim 1, wherein the linkage assembly is pivotably coupled to the frame of the carriage assembly.

11. The spinner tool of claim 1, wherein the pair of spring cylinders positioned on opposite sides of each one of the pair of carriage rollers are coupled to opposite ends of the respective one of the pair of carriage rollers.

12. A spinner tool, comprising;

a plurality of rollers configured to rotate a tubular; and a carriage assembly configured to support the plurality of rollers, wherein the carriage assembly has a frame, a pair of carriage rollers positioned on opposite sides of the frame and configured to roll along a column structure supporting the carriage assembly as the carriage assembly moves vertically along the column structure, and a pair of spring cylinders positioned on opposite sides of each one of the pair of carriage rollers and adjacent to the respective one of the pair of carriage rollers, wherein the spring cylinders are coupled at one end to the respective one of the pair of carriage rollers and at an opposite end to the frame to force the carriage assembly into a centered position.

13. The spinner tool of claim 12, wherein the pair of spring cylinders positioned on opposite sides of each one of the pair of carriage rollers are coupled to opposite ends of the respective one of the pair of carriage rollers.

14. The spinner tool of claim 12, wherein the carriage assembly is coupled to the column structure such that the carriage rollers are positioned on opposite sides of the column structure to keep the plurality of rollers level.

15. The spinner tool of claim 14, wherein the carriage assembly is supported on a spring located within the column structure.

16. The spinner tool of claim 12, wherein one of the pair of carriage rollers is positioned on top of the frame, and wherein the other of the pair of carriage rollers is positioned on bottom of the frame.

17. The spinner tool of claim 12, wherein one of the pair of carriage rollers is positioned near a rear side of the frame, and wherein the other of the pair of carriage rollers is positioned near a front side of the frame.

18. The spinner tool of claim 12, further comprising a rod member disposed in each spring cylinder, wherein each rod member is coupled at one end to one of the pair of carriage rollers and is biased at an opposite end by a spring located in the spring cylinder to force the carriage assembly into the centered position.

19. A spinner tool, comprising;

a plurality of rollers configured to rotate a tubular; and a carriage assembly configured to support the plurality of rollers, wherein the carriage assembly has a frame, a pair of carriage rollers positioned on opposite sides of the frame and configured to roll along a column structure supporting the carriage assembly as the carriage assembly moves vertically, a pair of wear pad housings coupled to the frame, wear pads that are biased toward the supporting column structure by springs located within the wear pad housings, and a pair of spring cylinders positioned on opposite sides of each one of the pair of carriage rollers and adjacent to the respective one of the pair of carriage rollers, wherein the spring cylinders include a spring in each spring cylinder configured to force the carriage rollers into a centered position, and the spring cylinders are coupled at one end to the respective one of the pair of carriage rollers and at an opposite end to the frame to force the carriage assembly into a centered position.

20. The spinner tool of claim 19, wherein each pair of spring cylinders positioned on opposite sides of each one of the pair of carriage rollers are coupled to opposite ends of the respective one of the pair of carriage rollers.

* * * * *